US012194391B1

(12) United States Patent
Guo

(10) Patent No.: US 12,194,391 B1
(45) Date of Patent: Jan. 14, 2025

(54) DESKTOP PINBALL INTERACTION DEVICE

(71) Applicant: HONG KONG XIYAO INTERNATIONAL TRADING CO., LIMITED, Hong Kong (CN)

(72) Inventor: Shaojia Guo, Shantou (CN)

(73) Assignee: HONG KONG XIYAO INTERNATIONAL TRADING CO., LIMITED, Hong Kong (CN)

( * ) Notice: Subject to any disclaimer, the term of this patent is extended or adjusted under 35 U.S.C. 154(b) by 0 days.

(21) Appl. No.: 18/764,065

(22) Filed: Jul. 3, 2024

(30) Foreign Application Priority Data

Jun. 17, 2024 (CN) ..... 202421380525.8

(51) Int. Cl.
*A63F 7/02* (2006.01)

(52) U.S. Cl.
CPC ..... *A63F 7/027* (2013.01)

(58) Field of Classification Search
CPC ..... A63F 7/027
See application file for complete search history.

(56) References Cited

U.S. PATENT DOCUMENTS 3,810,622 A * 5/1974 Payne, Jr. ..... A63F 7/0684 273/108.56
4,765,622 A * 8/1988 Rienzo ..... A63F 7/305 273/108.5
4,998,729 A * 3/1991 Lischerelli ..... A63F 7/0017 273/123 R
6,457,711 B1 * 10/2002 Baulesh ..... A63B 67/002 273/108.1
7,798,495 B1 * 9/2010 Jolicoeur ..... A63F 7/26 273/237
8,434,762 B1 * 5/2013 Kerpovich ..... A63F 7/3603 273/108.1
2005/0001375 A1 * 1/2005 Tsai ..... A63F 7/0672 273/108.1

FOREIGN PATENT DOCUMENTS

CN 220142610 U 12/2023
CN 220609059 U 3/2024
CN 220632958 U 3/2024

* cited by examiner

*Primary Examiner* — Eugene L Kim
*Assistant Examiner* — Christopher Glenn
(74) *Attorney, Agent, or Firm* — Nitin Kaushik

(57) ABSTRACT

The present invention belongs to the technical field of desktop pinball, and relates to a desktop pinball interaction device, including: a base, a surface of the base being provided with a table top for placing a pinball, and an edge of the table top being provided with two or more goals; ball striking devices, the ball striking devices being slidably mounted on the base through driving devices, and the two or more of the ball striking devices being respectively mounted at different goals; goal sensors, positions of the goal sensors corresponding to positions of the goals and being used for detecting the pinball; and remote control handles, the two or more of the remote control handles being used for respectively controlling different driving devices and ball striking devices.

9 Claims, 8 Drawing Sheets

DESKTOP PINBALL INTERACTION DEVICE

CROSS-REFERENCE TO RELATED APPLICATIONS

The application claims priority to Chinese patent application No. 2024213805258, filed on Jun. 17, 2024, the entire contents of which are incorporated herein by reference.

TECHNICAL FIELD

The present invention belongs to the technical field of desktop pinball, and relates to a desktop pinball interaction device.

BACKGROUND

With continuous progress of science and technology and diversification of entertainment manners, people have increased demands for interactive entertainment. The traditional pinball game has certain entertainment, but is often limited to single-person operation, lacks multi-person interaction and social elements, and is difficult to meet the requirements of modern users for social interaction and team cooperation.

A pinball game platform capable of supporting simultaneous operation of a plurality of persons is designed to enhance interaction among players, which is an urgent problem to be solved.

SUMMARY

In view of the shortcomings in the prior art, an objective of the present invention is to provide a desktop pinball interaction device.

To achieve the foregoing objective, the present invention adopts the following technical solution:

a desktop pinball interaction device, including:

a base, a surface of the base being provided with a table top for placing a pinball, and an edge of the table top being provided with two or more goals;

ball striking devices, the ball striking devices being slidably mounted on the base through driving devices, and two or more of the ball striking devices being respectively mounted at different goals;

goal sensors, positions of the goal sensors corresponding to positions of the goals and being used for detecting the pinball; and remote control handles, two or more of the remote control handles being used for respectively controlling different driving devices and ball striking devices, where the driving devices are used for driving displacement of the ball striking devices, the ball striking devices are used for striking the pinball, and surfaces of the remote control handles and surfaces of the ball striking devices are provided with identification portions corresponding to each other.

Further, the desktop pinball interaction device further includes a ball striking housing and ball striking sliding blocks, where the ball striking sliding blocks are slidably mounted on the ball striking housing, and a ball striking driving module for driving displacement of the ball striking sliding blocks is arranged in the ball striking housing.

Further, each driving device includes a driving housing, a displacement motor and a displacement gear, and the displacement motor is located in the driving housing and drives, through a transmission member, the displacement gear on a surface of the driving housing to rotate;

a cavity is arranged below the table top of the base, the driving devices are located in the cavity, a sliding rod is arranged in the cavity, the driving devices are slidably mounted on the sliding rod through the sliding block fixedly connected to the driving housing, a through groove is arranged on a side wall of the cavity, and the driving housing extends from the through groove to an outer side of the cavity and is fixedly connected to the ball striking device; and a rack is arranged below an edge of the table top, and the displacement gear is engaged with the rack for driving the driving devices to slide along the sliding rod.

Further, a roller is arranged at a top end of the driving housing, and the roller is located on a side away from the ball striking device; and the roller is in close contact with a top surface of the cavity, and the roller cooperates with the sliding rod for maintaining balance of the ball striking device on the other side.

Further, the base is provided with a groove, a position of the groove corresponds to a position of the goal, and the groove is used for accommodating the pinball.

Further, a periphery of the base is provided with a baffle plate, a height of the baffle plate is greater than that of the table top, and the groove is located between the table top and the baffle plate.

Further, the goal sensor is a photoelectric sensor or a gravity sensor.

Further, the identification portion is a color or a number or a pattern.

Further, the base is provided with placing tables at apex angles of the table top, a surface of each placing table is provided with a receiving groove for receiving the remote control handle, and the goal is located between the adjacent placing tables.

Further, the desktop pinball interaction device further includes a baffle strip, where a side surface of the placing table is provided with an insertion groove, two ends of the baffle strip are provided with insertion strips, the baffle strip is detachably mounted between the adjacent placing tables through the insertion strips, and the baffle strip is used for dividing the table top to limit a movement space of the pinball.

The technical solution of the present invention is applied, and the two or more ball striking devices and the corresponding remote control handles are designed to allow a plurality of players to participate in a game at the same time, thereby enhancing interaction and cooperation among players. The design of the identification portions improve friendliness of user operations, enabling the players to quickly identify and operate their respective ball striking devices. The overall design takes into account the game experience of the player, and through optimization of various details, such as the arrangement of the groove, the accurate detection of the sensor and the like, the interestingness and challenge of the game are improved.

Additional features and advantages of the invention will be set forth in the description which follows, and in part will be obvious from the description, or may be learned by implementing the invention. The objectives and other advantages of the present invention may be realized and obtained by a structure particularly pointed out in the written specification and drawings.

BRIEF DESCRIPTION OF THE DRAWINGS

The present invention will be described in detail below with reference to the drawings, so as to make the above advantages of the present invention more clear.

DETAILED DESCRIPTION OF THE EMBODIMENTS

Embodiments of the present invention are described in detail below and examples of the embodiments are shown in the accompanying drawings, where the same or similar reference signs always represent the same or similar elements or elements with the same or similar functions. The embodiments described below with reference to the accompanying drawings are exemplary, and are intended to explain the present invention, but shall not be understood as a limitation on the present invention.

In the description of the present invention, it should be noted that, the orientations or positional relationships indicated by the terms "length", "width", "up", "down", "front", "back", "left", "right", "vertical", "horizontal", "top", "bottom", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention.

Furthermore, the terms "first" and "second" are intended only for descriptive purposes and should not be construed as indicating or implying their relative importance or implying the quantity of technical features indicated. Therefore, a feature limited by "first" or "second" may explicitly or implicitly include one or more features. In the description of the present invention, the meaning of "plurality" is at least two, unless otherwise specifically defined.

In the embodiments of the present invention, unless otherwise expressly specified and defined, the terms "mounted", "attached", "connected", "fixed", etc. should be understood in a broad sense, for example, a connection may be a fixed connection, a detachable connection, or an integral connection; it may be a mechanical connection or an electrical connection; it may be a direct connection or an indirect connection via an intermediate medium; and it may be a connection between two elements or an interaction between two elements. For those of ordinary skill in the art, the specific meanings of the above terms in the present invention can be understood on a case-by-case basis.

Figure 1:
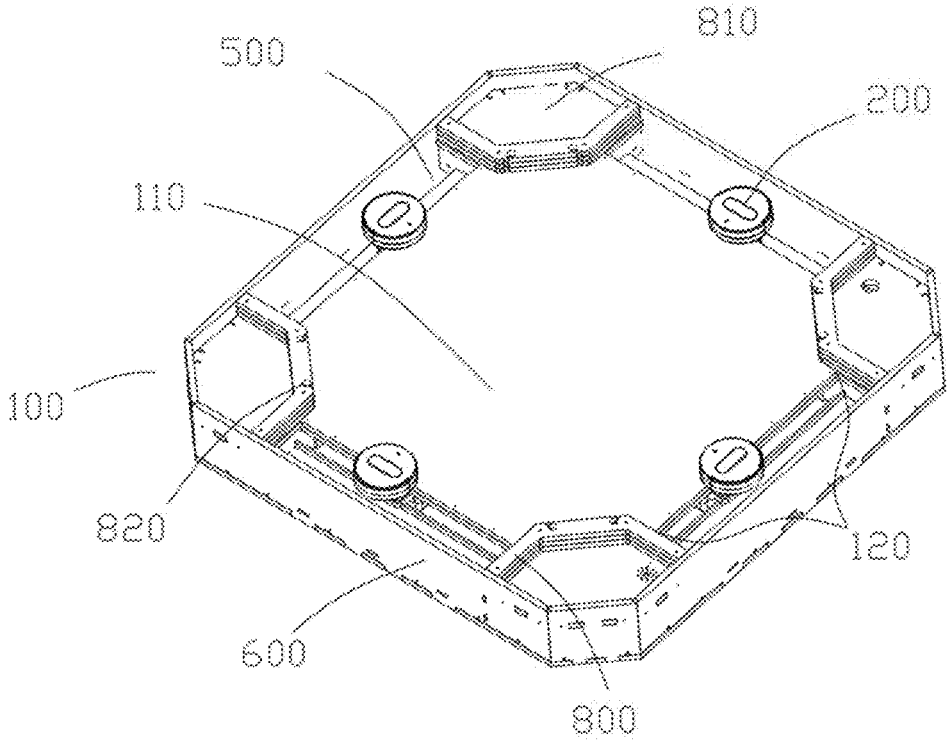
FIG. 1 is a schematic diagram of a desktop pinball interaction device according to the present invention.
Figure 2:
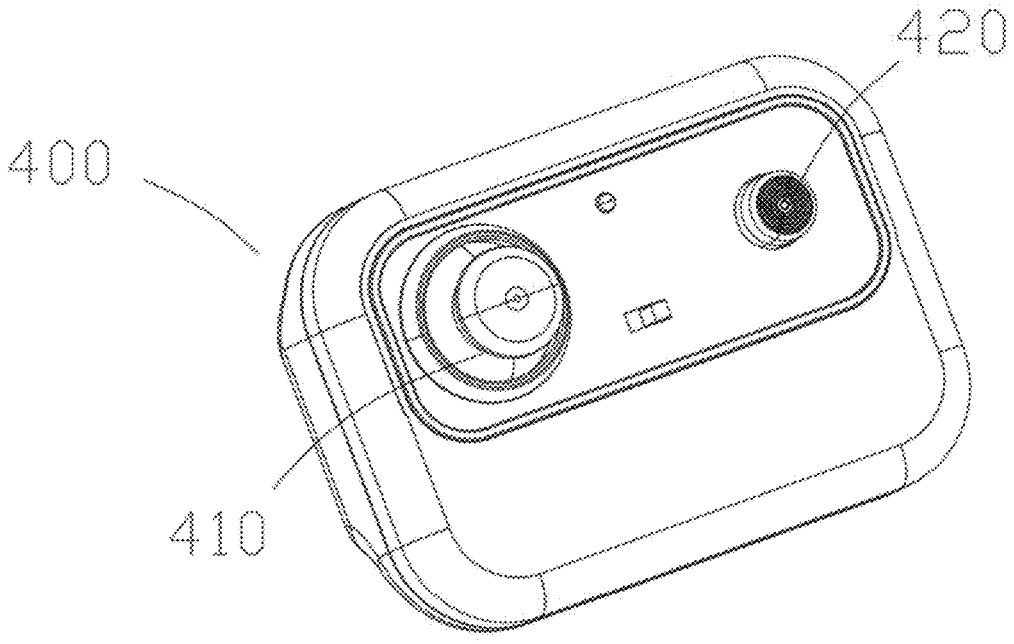
FIG. 2 is a schematic diagram of a remote control handle of a desktop pinball interaction device according to the present invention.

Referring to FIG. 1 and FIG. 2, a desktop pinball interaction device, including:

- a base 100, a surface of the base 100 being provided with a table top 110 for placing a pinball, and an edge of the table top 110 being provided with two or more goals 120;
- ball striking devices 200, the ball striking devices 200 being slidably mounted on the base 100 through a driving devices 300, and the two or more of the ball striking devices in 200 being respectively mounted at different goals 120;
- goal sensors, positions of the goal sensors corresponding to positions of the goals 120 and being used for detecting the pinball; and
- remote control handles 400, two or more of the remote control handles 400 being used for respectively controlling different driving devices 300 and ball striking devices 200, where
- the driving devices 300 are used for driving displacement of the ball striking devices 200, the ball striking devices 200 are used for striking the pinball, and surfaces of the remote control handles 400 and surfaces of the ball striking devices 200 are provided with identification portions corresponding to each other.

The table top 110 of the base 100 is designed as a main motion area of the pinball, and the edge of the table top is provided with a plurality of goals 120 for a player to shoot a target. Each goal 120 is provided with a ball striking device 200, and the ball striking device is slidably mounted on the base 100 through the driving device 300, so as to ensure that the ball striking device 200 can move on the table top 110. Each ball striking device 200 is equipped with a ball striking function, and striking of the pinball is achieved through operation of the remote control handle 400. A position of each goal 120 is equipped with a goal sensor for detecting ball inlet condition of the pinball, to achieve automatic scoring. The plurality of remote control handles 400 are used for respectively controlling different ball striking devices 200 and driving devices 300. Each remote control handle 400 is provided with a direction control button 410 and a ball striking button 420, and the movement and ball striking operation of the ball striking devices 200 can be controlled through the buttons. A central control unit is arranged in the device and is connected to the remote control handle 400 in a wired or wireless manner, so as to achieve coordinated control on each ball striking device 200 and the driving device 300. The central control unit is responsible for receiving a handle instruction and transmitting the handle instruction to the corresponding ball striking device 200 and the driving device 300.

After the device is powered on, the central control unit initializes each assembly, which includes the ball striking device 200, the driving device 300 and the goal sensor. The remote control handle 400 is connected to the central control unit in a wired or wireless manner. The player places the pinball on the table top 110, and the game is ready to start. The player controls the ball striking device 200 to slide along the base 100 through the direction control button of the remote control handle 400 to adjust a ball striking position. When each ball striking device 200 is in an appropriate position, the player presses the ball striking button 420, causing the ball striking device 200 strikes the pinball, so that the pinball moves on the table top 110. Each player plays against each other by operating the ball striking device 200 and the driving device 300, and aims to hit the pinball into the goal 120 of the opponent. When the pinball passes through the goal 120 of the opponent, the goal sensor detects the pinball, and the ball inlet condition is recorded through the central control unit and performs scoring. At the end of the game, the score of each player is counted by the central control unit, so as to determine win or lose.

The simultaneous operation of a plurality of players improves the interactivity and sociability of the game, which is suitable for family entertainment and a friend gathering. The goal sensor realizes automatic detection and scoring, reduces human intervention, and ensures the fairness and fluency of the game. The design of the plurality of goals 120 and ball striking devices 200 provide a variety of game play and strategies, thereby increasing the interestingness and challenge of the game. The design of the remote control handle 400 enables the player to flexibly control positions and ball striking operation of the ball striking devices 200, providing a higher sense of game control and engagement.

In this embodiment, a loudspeaker is further arranged on the base 100, and the loudspeaker is connected to the central control unit and is used for playing sound effects such as a score. The sound effect such as the score is played through the loudspeaker, instant auditory feedback is provided for the player, and a sense of immersion of the game is enhanced. The sound effect can be used as a medium for interaction between players, and a social element of the game is added. The setting of the loudspeaker provides a basis for possible multimedia integration in the future, such as background music and voice prompt. The loudspeaker can play a score sound effect of in real time, so that the player can quickly know its own performance. The player obtains instant feedback and knows the process of the game and his/her own operation result through the heard sound effect. The central control unit monitors score condition or other events requiring sound effect feedback during the game. The central control unit triggers a corresponding sound effect signal according to the monitored event, and sends the sound effect signal to the loudspeaker. After receiving the signal, the loudspeaker plays a preset score sound effect or other sound effects, such as goal-in and error-loss.

Figure 3:
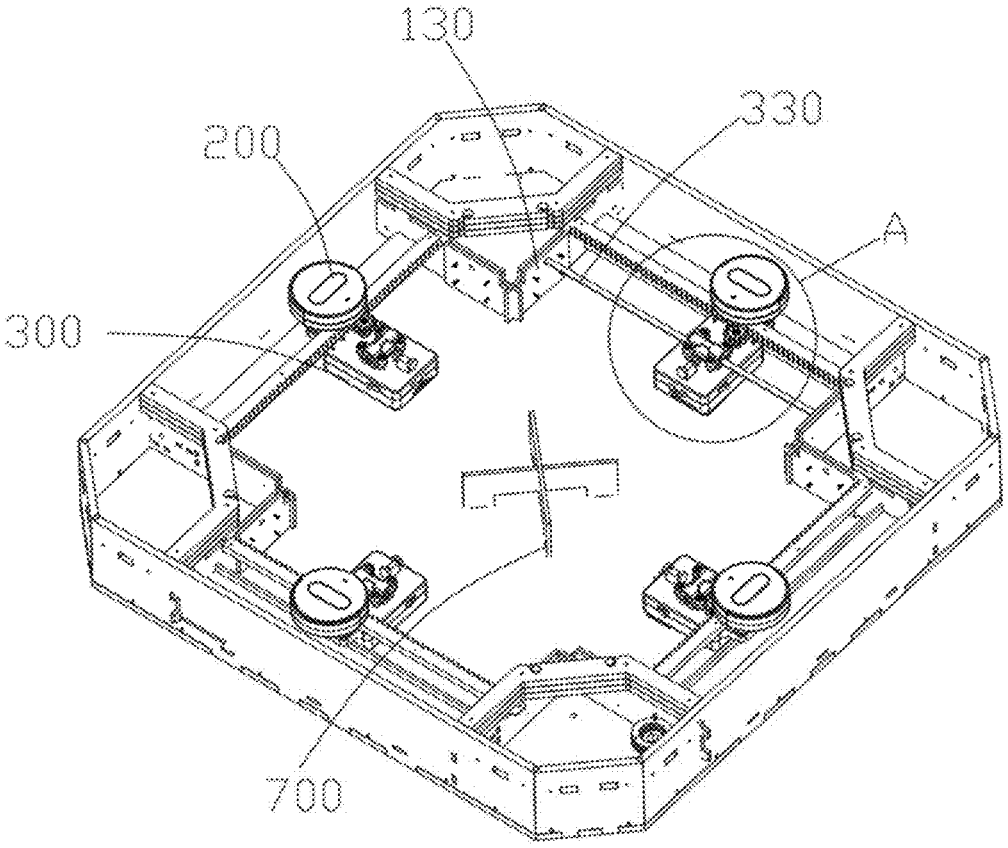
FIG. 3 is an internal schematic diagram of a desktop pinball interaction device according to the present invention.
Figure 4:
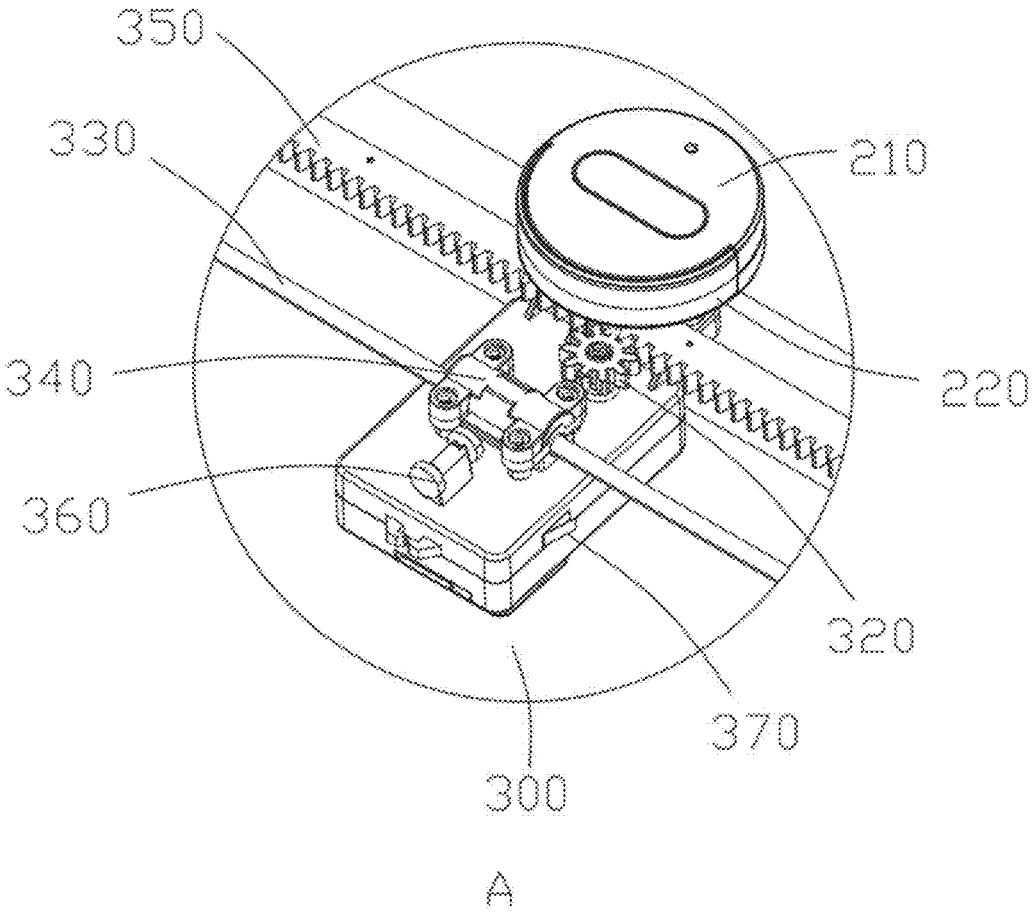
FIG. 4 is a schematic diagram of a driving device of a desktop pinball interaction device according to the present invention.

Referring to FIG. 3 and FIG. 4, in this embodiment, the desktop pinball interaction device further includes a ball striking housing 210 and ball striking sliding blocks 220, where the ball striking sliding blocks 220 are slidably mounted on the ball striking housing 210, and a ball striking driving module for driving displacement of the ball striking sliding blocks 220 is arranged in the ball striking housing 210. The ball striking housing 210 serves as an external structure of the whole ball striking device 200 to provide support and protection. The ball striking sliding blocks 220 are mounted in the ball striking housing 210 and can slide along a specific direction for actual ball striking operation. The ball striking driving module is arranged in the ball striking housing 210, and the ball striking function is achieved by controlling the displacement of the ball striking sliding blocks 220. A common ball striking driving module adopts an electromagnetic driving manner, and strong and accurate striking strength is provided by utilizing the quick response characteristic of electromagnetic force.

After the electromagnetic of the ball striking driving module is energized, a magnetic field is generated to attract or repel the ball striking sliding blocks 220, so that the ball striking driving module moves quickly along a preset trajectory and striking the pinball. An electromagnetic driving module has a fast response speed and high control precision, so that accurate displacement of the ball striking sliding blocks 220 can be achieved, and accuracy and consistency of the ball striking are guaranteed. The electromagnetic driving provides a powerful instantaneous force, so that the ball striking sliding blocks 220 can quickly and forcefully strike the pinball, thereby improving the intensity and interestingness of the game.

The player controls the ball striking module to slide along the base 100 through the direction control button of the remote control handle 400 to align the pinball. The driving devices 300 are used for driving displacement of the ball striking module, so that a position of the ball striking module is aligned with the pinball. When the ball striking module is aligned with the pinball, the player presses the ball striking button 420 of the remote control handle 400. The control signal is transmitted to the central control unit, and the central control unit controls the electromagnetic driving module to enable the ball striking sliding blocks 220 to quickly extends out, so as to strike the pinball. After the electromagnetic driving module is energized, a magnetic field is generated to drive the ball striking sliding blocks 220 to move quickly along the trajectory, so that a ball striking action is completed.

In this embodiment, a ball striking surface of each ball striking sliding block 220 is a curved surface. On the one hand, during ball striking, the ball striking surface of the curved surface can make the direction of the pinball more random, and the motion trail is more difficult to determine, thereby increasing the interestingness. On the other hand, in the event of four-person match-up, the ball striking surface of the curved surface has a higher probability to strike the pinball to an adjacent side, which greatly improves the interactivity of the multi-person game.

Figure 8:
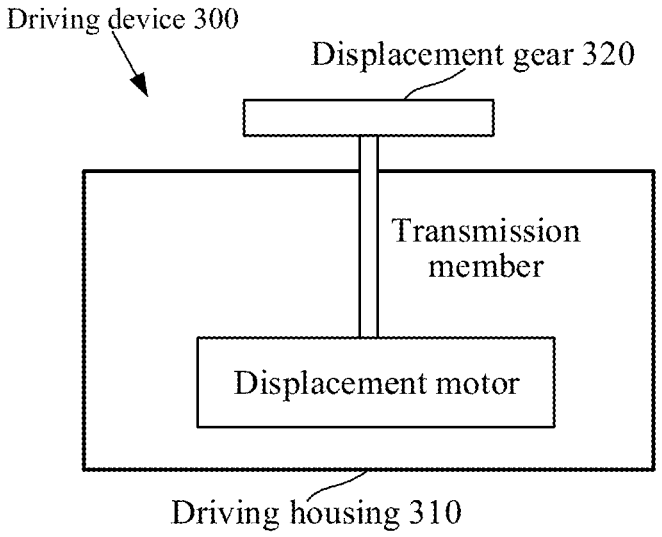
FIG. 8 is a schematic diagram of the driving device.

In this embodiment, as shown in FIG. 8, each driving device 300 includes a driving housing 310, a displacement motor and a displacement gear 320, and the displacement motor is located in the driving housing 310 and drives, through a transmission member, the displacement gear 320 on a surface of the driving housing 310 to rotate;

a cavity is arranged below the table top 110 of the base 100, the driving devices 300 are located in the cavity, a sliding rod 330 is arranged in the cavity, the driving devices 300 are slidably mounted on the sliding rod 330 through the sliding block 340 fixedly connected to the driving housing 310, a through groove 150 is arranged on a side wall of the cavity, and the driving housing 310 extends from the through groove 150 to an outer side of the cavity and is fixedly connected to the ball striking device 200; and a rack 350 is arranged below an edge of the table top 110, and the displacement gear 320 is engaged with the rack 350 for driving the driving devices 300 to slide along the sliding rod 330.

The driving devices 300 are integrated into the cavity of the base 100, thereby achieving a compact layout, reducing occupied space, and meanwhile, facilitating maintenance and hiding of mechanical components. The design of assemblies such as the displacement motor, the displacement gear 320, the sliding rod 330 and the rack 350 allows independent replacement and upgrade, thereby improving the flexibility and maintainability of the system. The driving devices 300 are placed in the cavity below the table top 110, so as to keep cleanliness and the aesthetics of the table top 110, and meanwhile, reduce the interference to the operation of the player.

The cavity is arranged below the table top 110, so that the space is effectively utilized, and meanwhile, a mechanical structure is hidden, thereby improving the overall aesthetics.

The driving devices 300 are located below the table top 110 and have a low center of gravity, thereby improving the stability of the whole system. The engaged transmission design of the displacement gear 320 and the rack 350 provides a stable and efficient power transmission manner. The cooperative use of the sliding block 340 and the sliding rod 330 allows each driving devices 300 to move smoothly on the sliding rod 330, thereby achieving accurate position control.

The displacement motor receives a signal from the central control unit, and starts or stops according to an operation instruction of the player. The displacement motor drives the displacement gear 320 to rotate through the transmission member, thereby achieving the transmission of power. The displacement gear 320 is engaged with the rack 350 below the edge of the table top 110, thereby driving the ball striking device 200 to move below the table top 110. The player controls the rotation direction and speed of the motor through the remote control handle 400, so as to achieve accurate position adjustment of the ball striking device 200 below the table top 110. After the ball striking device 200 moves to an appropriate position, the player operates the ball striking button 420 to perform a ball striking action.

Figure 5:
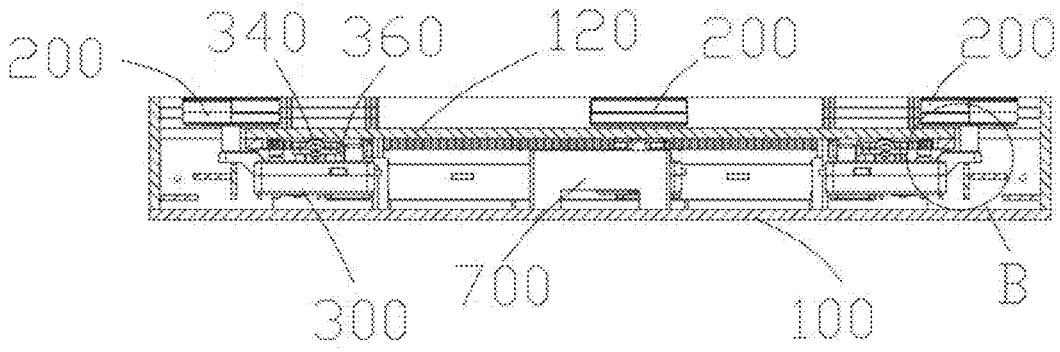
FIG. 5 is a sectional view of a desktop pinball interaction device according to the present invention.
Figure 6:
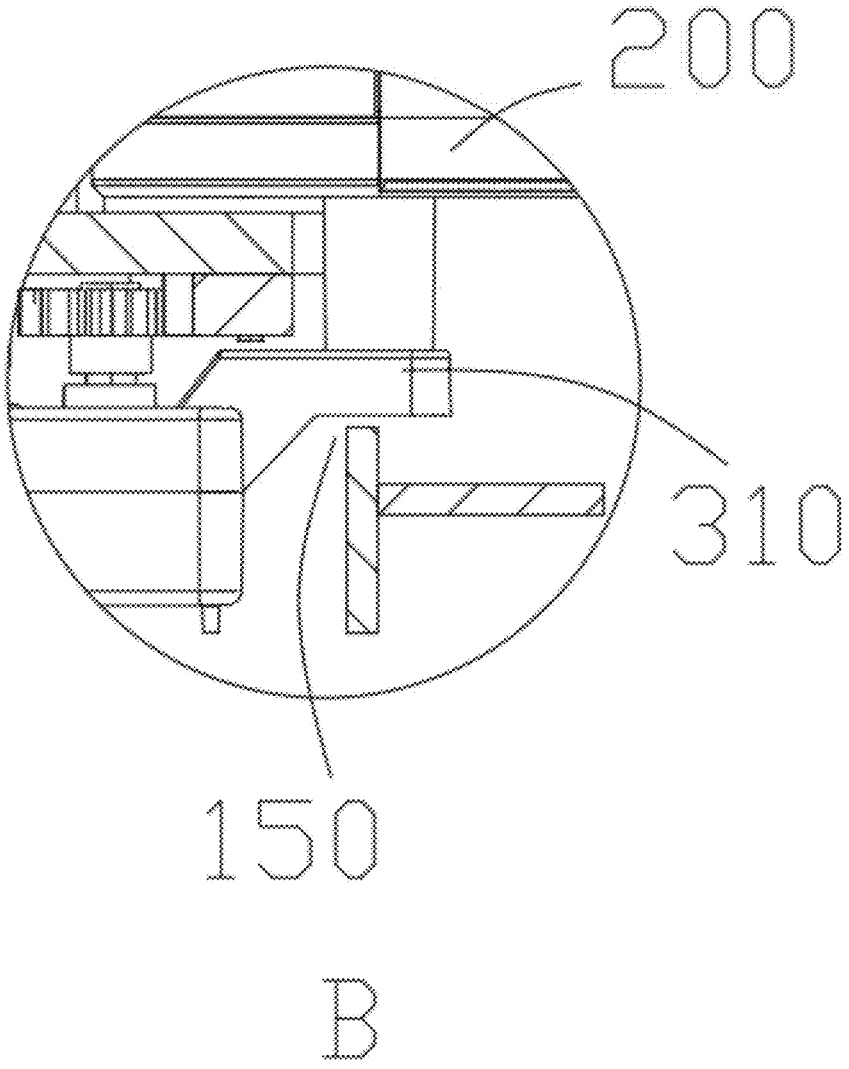
FIG. 6 is an enlarged schematic diagram of a through groove of a desktop pinball interaction device according to the present invention.

Referring to FIG. 5 and FIG. 6, in this embodiment, a roller 360 is arranged at a top end of the driving housing 310, and the roller 360 is located on a side away from the ball striking device 200; and the roller 360 is in close contact with a top surface of the cavity, and the roller 360 cooperates with the sliding rod 330 for maintaining balance of the ball striking device 200 on the other side. The driving housing 310 extends from the through groove 150 to an outer side of the cavity and is fixedly connected to the ball striking device 200, and the ball striking device 200, the sliding rod 330 and the roller 360 form a lever-like force. Through cooperation of the sliding rod 330 and the roller 360, when the driving housing 310 penetrates through the through groove 150, the driving housing 310 is not in contact with an upper side and a lower side of the through groove 150, so that abrasion is avoided. Compared with a sliding rail with a sliding groove, the present invention has a lower cost and a more convenient installation.

The roller 360 is arranged at the top end of the driving housing 310, so that the roller is in close contact with the top surface of the cavity, and a lever-like force receiving structure is formed, so as to maintain the balance of the ball striking device 200 on the other side. With the cooperation of the roller 360 and the sliding rod 330, it is avoided that the driving housing 310 is in contact with the upper side and the lower side of the groove when penetrating through the through groove 150, thereby reducing abrasion and prolonging a service life. Compared with a conventional sliding rail of a sliding groove, the cooperation design of the roller 360 and the sliding rod 330 is lower in cost and more convenient in mounting, simplifying production and maintenance procedure.

In this embodiment, two sides of each driving device 300 are provided with anti-collision switches 370, and two sides of the sliding rod 330 are provided with limiting plates 130. On the one hand, the limiting plate 130 is used to trigger the anti-collision switch 370, and after the central control unit receives a signal of the anti-collision switch 370, the displacement motor can be intervened in advance to prevent an impact or reduce an impact force. On the other hand, the displacement of the driving device 300 is interfered from a physical layer, a sliding formation of the driving device 300 is limited, and the driving device 300 is prevented from derailing.

The two sides of each driving device 300 are provided with the anti-collision switches 370, and the two sides of the sliding rod 330 are provided with the limiting plates 130, so that the safety of the system is enhanced, and the impact or derailment caused by misoperation or mechanical failure is prevented. The limiting plate 130 is used to trigger the anti-collision switch 370, so as to implement an advance intervention on the displacement motor, thereby reducing the impact force or avoiding the impact. The anti-collision switch 370 and the limiting plate 130 provide a dual protection mechanism, thereby ensuring stability and security of the system.

During normal operation, the player controls the displacement motor through the remote control handle 400 to drive the driving device 300 to move along the sliding rod 330. When the driving device 300 moves to a physical limit position close to the sliding rod 330, the limiting plate 130 contacts the driving device 300. The limiting plate 130 triggers the anti-collision switch 370 to send a signal to the central control unit. After receiving the signal of the anti-collision switch 370, the central control unit intervenes in the displacement motor in advance according to signal determination condition, to stop or decelerate the motor operation. Through the intervention of the central control unit, the impact is avoided or reduced, and the mechanical structure and player safety are protected. Even when an electronic control system fails, the limiting plate 130 can also physically limit the displacement of the driving device 300 to prevent derailment. The limiting plate 130 provides a physical constraint, so that the driving device 300 can be prevented from derailing even in the case that the electronic control system fails.

In this embodiment, a support plate 700 is arranged in the cavity below the table top 110, and the support plate 700 abuts against a bottom surface of the table top 110. A central recess caused by an excessively large area of the table top 110 is prevented. Considering possible deformation problems in long-term use, structural reinforcement is performed in advance through the support plate 700. The support plate 700 abuts against the bottom surface of the table top 110, which helps to more evenly distribute the load on the table top 110 and reduce local stress concentration. The support plate 700 is arranged in the cavity below the table top 110, so that the overall rigidity and stability of the table top 110 are enhanced, and the central recess caused by the excessively large area is avoided. By reinforcing the structure of the table top 110, the service life of the whole device is prolonged, and requirements for maintenance and replacement are reduced. The support plate 700 continuously provides support to the table top 110, which maintains flatness of the table top regardless of whether the table top 110 is in use.

In this embodiment, the base 100 is provided with a groove 500, a position of the groove 500 corresponds to a position of the goal 120, and the groove 500 is used for accommodating the pinball. The groove 500 is arranged in the base 100, so as to provide a safe falling point for the pinball to pass through the goal 120, thereby preventing the pinball from being lost or bounced. That is, the pinball falls into the groove 500 after passing through the goal 120. The groove 500 can be used as a temporary storage point of the pinball, so that the player can quickly re-put into the game after scoring.

The groove 500 ensures that the pinball will not be lost after passing through the goal 120, maintaining continuity of the game. During the game, the pinball is struck by the ball striking device and moves toward the goal 120. When the pinball passes through the goal 120 successfully, the pinball falls into the corresponding groove 500 according to the designed motion trail. The design size and shape of the groove 500 is suitable for the accommodation of the pinball, ensuring that the pinball stably stays in the groove 500. The central control unit detects that the pinball falls into the groove 500, and trigger a score sound effect or displays a score. so as to provide feedback for the player. The player or system operates to remove the pinball from the groove 500, and replaces the pinball to the table top 110 of the game to continue the game.

In this embodiment, the goal sensors are photoelectric sensors, and the goal sensors are located on two sides of the goal 120. When it is detected that the pinball passes, it is determined that the pinball has scored and one point is counted. With the high sensitivity of the photoelectric sensors, accurate detection of the pinball passing through the goal 120 is achieved. When the pinball breaks light beams of the photoelectric sensors, a goal signal is immediately triggered to provide quick feedback.

A transmit end and a receive end of each photoelectric sensor are respectively located on two sides of the goal 120 to form a light beam. When the pinball passes through the goal 120, the light beam is broken, and the photoelectric sensor detects this change. The sensor converts this change into an electrical signal and sends the electrical signal to the central control unit. After receiving the signal, the central control unit determines that the pinball is goaled, and performs scoring. The photoelectric sensor can provide very accurate goal detection, thereby reducing the possibility of misjudgment. The photoelectric sensor can quickly respond to an action through which the pinball passes, so as to realize real-time scoring.

Alternatively, the goal sensor is arranged at the bottom end of the groove 500, and a gravity sensor is adopted. When the pinball falls into the groove, the value of the gravity sensor changes, and it is determined that the pinball is goaled and one point is counted. The change in gravity caused by the pinball falling into the groove 500 is utilized to detect a goal. The gravity sensor is arranged at the bottom of the groove 500, which simplifies the layout and mounting of the sensor.

The gravity sensor is mounted at the bottom end of the groove 500 for detecting a weight of the pinball. When the pinball falls into the groove 500, its weight acts on the gravity sensor, resulting in a change in the value. The gravity sensor detects a change in weight and converts this change into an electrical signal. The electrical signal is sent to the central control unit, and the central control unit determines the goal according to the signal and performs scoring.

The gravity sensor is not interfered by light and provides a stable detection result. The gravity sensor may have a lower cost relative to the photoelectric sensor. The gravity sensor has a simple structure and is easy to maintain and replace.

In this embodiment, a periphery of the base 100 is provided with a baffle plate 600, a height of the baffle plate 600 is greater than that of the table top 110, and the groove 500 is located between the table top 110 and the baffle plate 600. The height of the baffle plate 600 is greater than that of the table top 110, thereby effectively preventing the pinball from jumping out of the base 100 during the game. The groove 500 is located between the table top 110 and the baffle plate 600, so as to ensure that the pinball can safely fall into the groove 500 after scoring, thereby facilitating scoring and management. The baffle plate 600 may prevent the pinball from flying out, thereby reducing potential hazards to surrounding environments and players. The cooperative use of the baffle plate 600 and the groove 500 provides a more fluent and ordered game experience for the players.

During the game, the pinball is struck by the ball striking device on the table top 110 and moves. When the pinball moves close to the edge of the base 100, the baffle plate 600 serves as a barrier to prevent the pinball from flying out of the base 100. After the pinball passes through the goal 120, it is detected as a score according to the set photoelectric sensor or gravity sensor. After scoring, the pinball falls into the groove 500, and the position and design of the groove 500 ensure that the pinball is stably stored. The central control unit performs scoring according to the sensor signal, and can play a score sound effect through a loudspeaker, so as to provide feedback for the player.

In this embodiment, the identification portion is a color or a number or a pattern. The device is a multi-person interactive game, and has a plurality of remote control handles 400 for respectively controlling different ball striking devices 200 and driving devices 300. With the identification portion, the user can quickly recognize and determine which of the ball striking device 200 is controlled by his/her own remote control handle 400.

Each remote control handle 400 and the corresponding ball striking device 200 are provided with unique visual identifications by using colors, numbers, or patterns as identifications. The design of the identification portion enables the player to quickly recognize his/her own control device, thereby reducing confusion and errors during operation. The clear identification helps the player to quickly react in a multi-player game, thereby improving interaction experience.

A unique color, a number or a pattern is assigned to each remote control handle 400 and the corresponding ball striking device 200 as an identification. The player quickly recognize the device controlled by himself/herself by observing the identification on the remote control handle 400 and the ball striking device 200. The player operates based on his/her own identification to ensure that the control instruction is correctly communicated to the corresponding ball striking device 200.

The color, the number, or the pattern serves as an identification, providing an intuitive visual distinction, which facilitates recognizing for the player. In the multi-player game, the clear identification helps to reduce confusion of the player on the control device, thereby improving the fluency of the game. The identification can be customized according to the design and player preferences, thereby providing a personalized experience.

In this embodiment, the base 100 is provided with placing tables 800 at apex angles of the table top 110, a surface of each placing table 800 is provided with a receiving groove 810 for receiving the remote control handle 400, and the goal 120 is located between the adjacent placing tables 800. The design of the placing table 800 integrates two functions of the goal 120 separation and the remote control handle 400 receiving, thereby improving space utilization efficiency. The receiving groove 810 is arranged on the placing table 800, so that it is convenient for the player to store the remote control handle 400 in the game gap or after the game is finished. The design of the placing table 800 is both practical and beautiful, and is coordinated with the design style of the whole desktop pinball interaction device.

The design of the placing table 800 effectively utilizes the apex angle space of the table top 110, thereby avoiding space wasting. The placing table 800 is located at the apex angle of the table top 110 and naturally forms a separation of adjacent areas as a boundary of the goal 120. The position of the receiving groove 810 facilitates quick access or storage of the remote control handle 400 by the player when needed.

The player may place the remote control handle 400 into the corresponding receiving groove 810 before the game starts of after the game ends.

Figure 7:
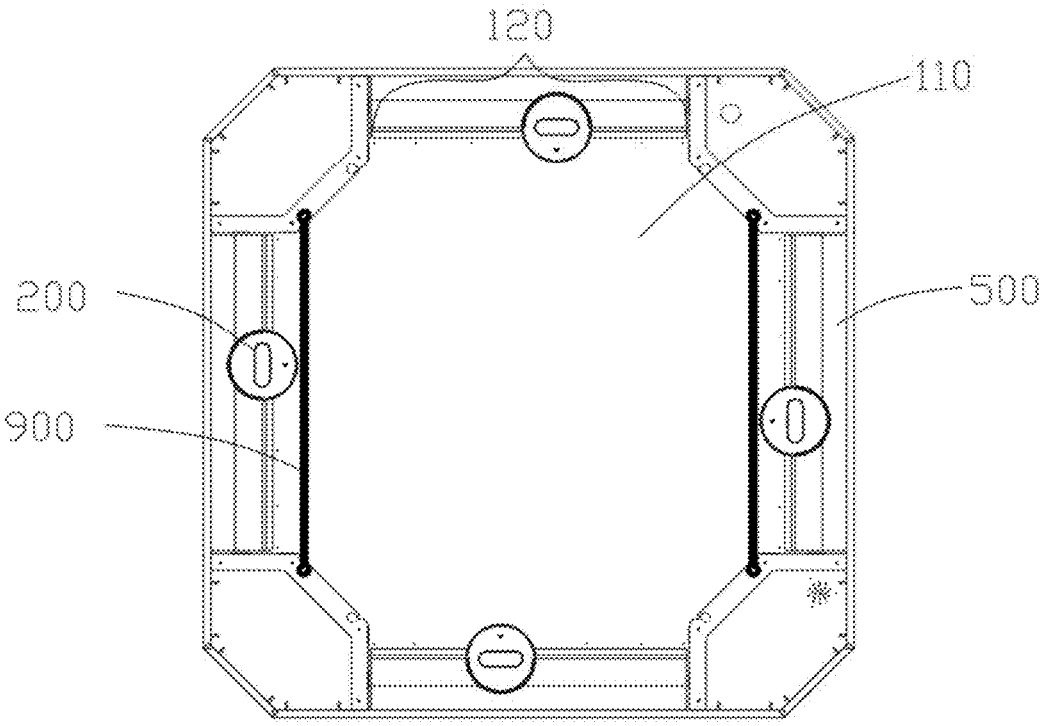
FIG. 7 is a schematic diagram of a use of a baffle strip of a desktop pinball interaction device according to the present invention.

Referring to FIG. 7, in this embodiment, the desktop pinball interaction device further includes a baffle strip 900, where a side surface of the placing table 800 is provided with an insertion groove 820, two ends of the baffle strip 900 are provided with insertion strips, the baffle strip is detachably mounted between the adjacent placing tables 800 through the insertion strips, and the baffle strip 900 is used for dividing the table top 110 to limit a movement space of the pinball. Taking a four-person interaction device as an example, when only two or three users, the ball striking device 200 on one side will be unmanned, and if the pinball is bounced towards this side, the pinball can be easily pass through the goal 120, thereby interrupting the game and affecting the operation experience of the user. When there is a missing number of people, the unmanned operation side can be blocked by the baffle strip 900, and when the pinball is bounced towards this side, the pinball collides with the baffle strip 900 to change the direction, thereby ensuring the continuity of the game. The detachable baffle strip 900 reduces the requirement of the device for the number of users, and is more free to use. Even one person can perform entertainment practice alone.

The baffle strip 900 may be dynamically adjusted based on a change in the number of players, so as to adapt to a game mode from a single-person to a multi-person. When there are fewer than four players, the game experience is optimized through the use of the baffle strip 900, so as to avoid the game interruption caused by the area of unmanned operation. The design of the baffle strip 900 allows game practice in the single-person mode, increasing the usage scenario of the device.

According to the number of players, the baffle strip 900 is mounted between the insertion grooves 820 of the adjacent placing tables 800 through the insertion strip to form an obstacle. The baffle strip 900 is erected on the table top 110, dividing the table top 110, thereby limiting the range of movement of the pinball. When the pinball is bounced towards one side of the unmanned operation, the baffle strip 900 guides the pinball to change the direction and back to the area of manned operation. The use of the baffle strip 900 ensures that the game can be continued even when the number of people is insufficient, and will not be interrupted by the pinball passing through the goal 120. In a single-person mode, the baffle strip 900 may completely close the area of unmanned operation, so that the player may focus on his/her own operation and practice.

Finally, it should be noted that the foregoing descriptions are merely preferred embodiments of the present invention, but are not intended to limit the present invention. Although the present invention has been described in detail with reference to the foregoing embodiments, those skilled in the art will readily appreciate that they can make modifications to technical solutions recorded in the embodiments described herein, or make equivalent replacements of some of the features described herein. Any modifications, equivalent replacements, improvements, and the like made within the spirit and principle of the present invention shall fall within the protection scope of the present invention.

What is claimed is:

1. A desktop pinball interaction device, comprising:

a base (100), a surface of the base (100) being provided with a table top (110) for placing a pinball, and an edge of the table top (110) being provided with two or more goals (120);

ball striking devices (200), the ball striking devices (200) being slidably mounted on the base (100) through driving devices (300), and two or more of the ball striking devices (200) being respectively mounted at different goals (120);

goal sensors, positions of the goal sensors corresponding to positions of the goals (120) and being used for detecting the pinball; and remote control handles (400), two or more of the remote control handles (400) being used for respectively controlling different driving devices (300) and ball striking devices (200), wherein the driving devices (300) are used for driving displacement of the ball striking devices (200), the ball striking devices (200) are used for striking the pinball, and surfaces of the remote control handles (400) and surfaces of the ball striking devices (200) are provided with identification portions corresponding to each other;

each driving device (300) comprises a driving housing (310), a displacement motor and a displacement gear (320), and the displacement motor is located in the driving housing (310) and drives, through a transmission member, the displacement gear (320) on a surface of the driving housing (310) to rotate;

a cavity is arranged below the table top (110) of the base (100), the driving devices (300) are located in the cavity, a sliding rod (330) is arranged in the cavity, the driving devices (300) are slidably mounted on the sliding rod (330) through a sliding block (340) fixedly connected to the driving housing (310), a through groove (150) is arranged on a side wall of the cavity, and the driving housing (310) extends from the through groove (150) to an outer side of the cavity and is fixedly connected to the ball striking device (200); and a rack (350) is arranged below an edge of the table top (110), and the displacement gear (320) is engaged with the rack (350) for driving the driving devices (300) to slide along the sliding rod (330).

2. The desktop pinball interaction device according to claim 1, further comprising a ball striking housing (210) and ball striking sliding blocks (220), wherein the ball striking sliding blocks (220) are slidably mounted on the ball striking housing (210), and a ball striking driving module for driving displacement of the ball striking sliding blocks (220) is arranged in the ball striking housing (210).

3. The desktop pinball interaction device according to claim 1, wherein a roller (360) is arranged at a top end of the driving housing (310), and the roller (360) is located on a side away from the ball striking device (200); and the roller (360) is in close contact with a top surface of the cavity, and the roller (360) cooperates with the sliding rod (330) for maintaining balance of the ball striking device (200) on the other side.

4. The desktop pinball interaction device according to claim 1, wherein the base (100) is provided with a groove (500), a position of the groove (500) corresponds to a position of the goal (120), and the groove (500) is used for accommodating the pinball.

5. The desktop pinball interaction device according to claim 4, wherein a periphery of the base (100) is provided with a baffle plate (600), a height of the baffle plate (600) is greater than that of the table top (110), and the groove (500) is located between the table top (110) and the baffle plate (600).

6. The desktop pinball interaction device according to claim 4, wherein the goal sensor is a photoelectric sensor or a gravity sensor.

7. The desktop pinball interaction device according to claim 1, wherein the identification portion is a color or a number or a pattern.

8. The desktop pinball interaction device according to claim 1, wherein the base (100) is provided with placing tables (800) at apex angles of the table top (110), a surface of each placing table (800) is provided with a receiving groove (810) for receiving the remote control handle (400), and the goal (120) is located between the adjacent placing tables (800).

9. The desktop pinball interaction device according to claim 8, further comprising a baffle strip (900), wherein a side surface of the placing table (800) is provided with an insertion groove (820), two ends of the baffle strip (900) are provided with insertion strips, the baffle strip is detachably mounted between the adjacent placing tables (800) through the insertion strips, and the baffle strip (900) is used for dividing the table top (110) to limit a movement space of the pinball.

* * * * *